United States Patent [19]

Graham, Jr.

[11] Patent Number: 4,462,556

[45] Date of Patent: Jul. 31, 1984

[54] TUBE WITH REINFORCING STRIP

[75] Inventor: Woodrow W. Graham, Jr., Bennettsville, S.C.

[73] Assignee: Sonoco Products Company, Hartsville, S.C.

[21] Appl. No.: 481,028

[22] Filed: Mar. 31, 1983

[51] Int. Cl.[3] ..... B65H 75/10

[52] U.S. Cl. ..... 242/118.31; 138/129; 138/154; 242/118.32

[58] Field of Search ..... 242/118, 118.3, 118.31, 242/118.32; 138/129, 144, 150, 153, 154, 114, 128; 239/33; 229/4.5, 93; 426/122, 123, 124; 206/830; 220/414

[56] References Cited

U.S. PATENT DOCUMENTS

| | | | |
|---|---|---|---|
| 332,713 | 12/1885 | Hollett | 229/93 |
| 3,051,370 | 11/1959 | Hanlon | 206/830 |
| 3,304,185 | 2/1967 | Fortney | 426/122 |
| 3,357,594 | 12/1967 | Grosh | 220/414 X |
| 3,364,955 | 1/1968 | Gustafson | 138/144 |
| 3,554,237 | 1/1971 | Pelley | 138/154 X |
| 3,616,819 | 11/1971 | Dunlap | 138/154 X |
| 3,940,496 | 2/1976 | Turpin | 229/4.5 X |
| 3,980,249 | 9/1976 | Cunningham | 138/150 X |
| 4,073,950 | 2/1978 | Hansen | 426/122 X |

*Primary Examiner*—Stuart S. Levy
*Assistant Examiner*—Leo J. Peters
*Attorney, Agent, or Firm*—Dennison, Meserole, Pollack & Scheiner

[57] ABSTRACT

A composite tube for yarn winding or the like incorporating a body or base defined by a plurality of spirally wound plies of paperboard or the like, and a structural reinforcement ply about the body. The reinforcement ply, spirally wound in the manner of the body plies, includes adjoining square skived abutting edges forming a continuous spiralled groove which defines the seam area of the ply. A reinforcing and sealing strip is laid as a continuous member within the formed groove, filling the groove and being bonded to all surfaces thereof. The height of the strip is substantially equal to or slightly less than the depth of the groove. The tube is completed by surface defining plies including an inner ply of machine glazed kraft paper and an outer ply of parchment.

9 Claims, 6 Drawing Figures

TUBE WITH REINFORCING STRIP

BACKGROUND OF THE INVENTION

The invention is generally concerned with tube construction, and more particularly relates to tubes utilized as textile carriers. Such tubes are conventionally of a composite construction, formed multiple plies of a paper or paperboard product, wherein the individual plies are spirally wound with the edges thereof abutting. Each ply, in its entirety, is adhesively bonded to the adjacent ply or plies.

Carrier tubes, particularly during the winding of yarn or the like thereon, are subjected to substantial forces which can cause the tubes to disintegrate, outwardly explode, or otherwise destruct. Such tubes are particularly susceptible to damage at the initiation of the winding operation. It is at that time that the spindle mounted tubes, normally two tubes being simultaneously mounted on a common elongated spindle, are rather violently engaged by a rotating start-up drum which instantaneously causes the tubes to reach their maximum running speed. This speed can amount to a surface speed of as much as three to four thousand meters per minute.

Various solutions have been proposed with regard to the problem of "exploding" tubes. Attention is particularly directed to U.S. Pat. No. 3,980,249, Cunningham et al, issued Sept. 14, 1976. This patent, assigned to the same Assignee as the present application, sets forth the problems encountered when utilizing winding tubes of conventional construction, and suggests one effective solution.

SUMMARY OF THE INVENTION

It is the primary object of the present invention to provide a seam construction which substantially enhances the strength of the tube and its capability to resist an explosive disintegration in the work environment. This is effected through the use of a specific reinforcing ply about the main body of the tube and immediately inward of the surface-characteristic defining outer plies. The reinforcing ply uses square skived or compressed edges which abut each other, as in a conventional wound ply, but distinguish over the conventional ply by the outwardly directed channel defined by the opposed skived portions.

The defined channel, continuous along the spiral seam of the tube, receives an elongated continuous strip adhesively bonded therein. The strip, made of paperboard, Tyvek, Mylar, or the like, covers the adhesively bonded reduced height butted edges and is intimately engaged with and bonded to both the horizontal and vertical faces of each skive. The strip is of a width and depth which closely conform to the skive-defined channel with the strip outer surface normally being coplanar with or slightly depressed relative to the upper surface of the ply. In this manner, the seam construction provides the additional advantages of a smooth or projection free surface. The tube is completed by the adhesive bonding of overlying surface or texture defining plies, including an inner machine glazed kraft ply and an outer parchment ply.

Tubes constructed in this manner have been tested and found to incorporate a degree of strength and structural stability not heretofore available in the conventional butt joint tubes. The actual tests run on prototypes of the tube and utilizing strips of Tyvek or Mylar evidenced a substantial resistance to destruct at normally anticipated operating speeds of the winder. Upon an increase in the winder speed beyond the normal operating speed and up to approximately six thousand meters per minute, damage was noted. However, in most instances, this damage was limited, with the evidenced tearing and the like occurring in the body of the tube to the sides of the strip and seam strengthened thereby. In other words, while the seam, in a conventionally constructed tube, normally constitutes the weakest area, and the area at which damage is normally initiated, the specific manner herein proposed for the strengthening of the seam is effective in providing a seam which is as strong or stronger than the body of the tube remote from the seam. Further, as the seam follows a spiral path along and about the tube, there is a substantial resistance to a physical outward exploding or complete destructing of the tube even should damage occur. This in turn contributes to a safer work environment.

DESCRIPTION OF PREFERRED EMBODIMENTS

Figure 1:
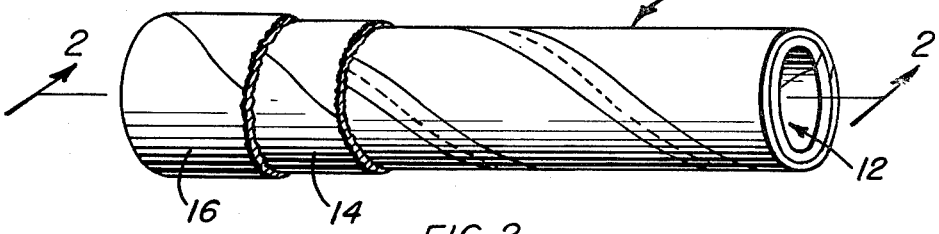
FIG. 1 is an elevational perspective view of a tube constructed in accordance with the instant invention wherein portions of the surface plies are broken away to expose the reinforcing ply.
Figure 2:
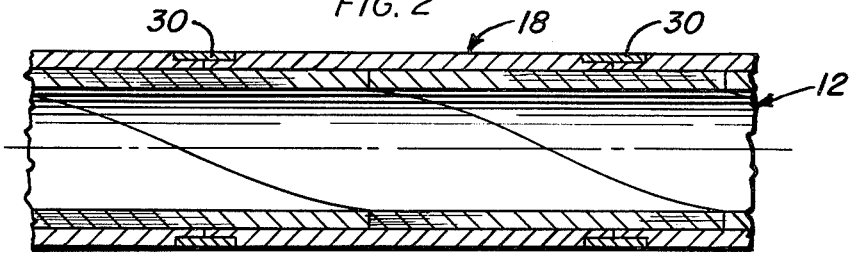
FIG. 2 is an enlarged cross-sectional view taken substantially on a plane passing along line 2—2 in FIG. 1.
Figure 3:
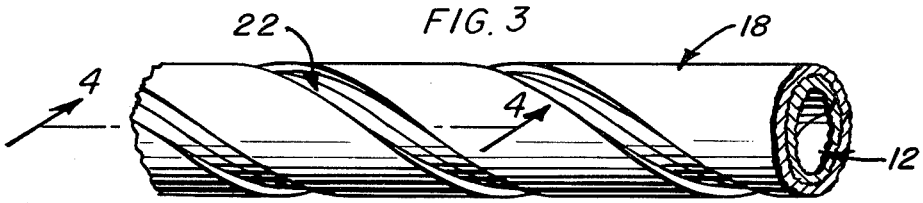
FIG. 3 is a perspective elevational view of a length of tube with the reinforcing ply exposed and prior to application of the reinforcing strip.
Figure 4:
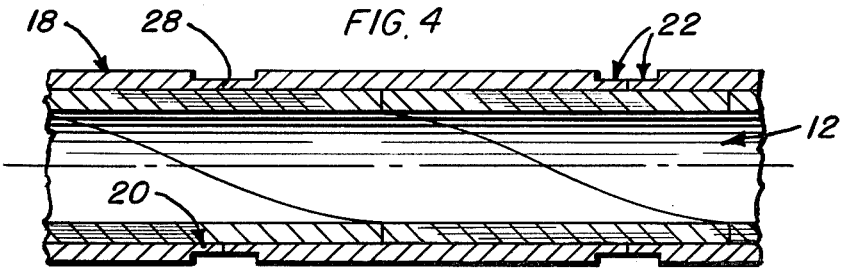
FIG. 4 is an enlarged cross-sectional view taken substantially along a plane passing along line 4—4 in FIG. 3.
Figure 5:
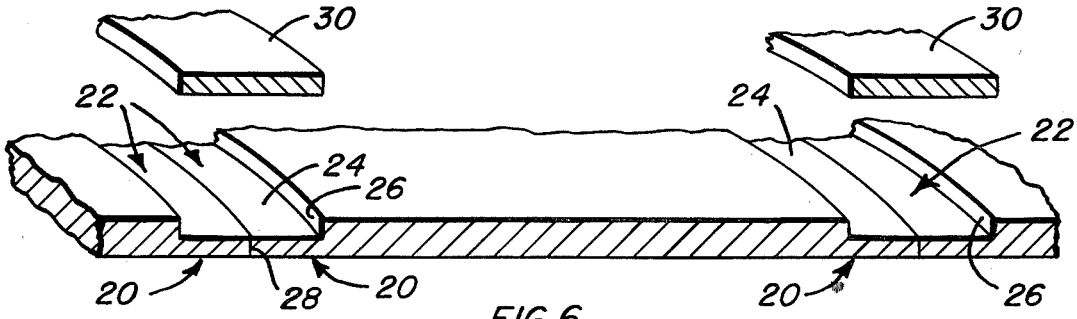
FIG. 5 is a perspective exploded detail illustrating the components of the seam in the reinforcing ply.

Referring now more specifically to the drawings, the tube of the present invention is generally designated by reference numeral 10. The major portion of the tube 10 is constructed in the manner of a conventional tube incorporating a base 12 defined by multiple spirally wrapped plies of paperboard or the like with the edge seams abutted, and a pair of outer or surface plies 14 and 16 which define the surface characteristics of the tube. The ply 14 will preferably be $5\frac{1}{4}$ inches by 0.0025 inches machine glazed kraft, while the outermost ply 16 will normally be of $5\frac{5}{8}$ inches by 0.002 inches white parchment. In each instance, the plies are completely adhesively bonded to the adjacent ply or plies.

The invention herein is particularly concerned with a tube reinforcing ply 18 spirally wound about and adhesively bonded to the ply defined body 12. The reinforcing ply 18 differs from the conventional body plies in that the opposed edge portions 20 are skived, compressed, or otherwise formed to define an outwardly directed recess 22 with an approximately right angular configuration including a base 24 and an inner side wall 26 rising or extending outward therefrom. Upon a spiral wrapping of the reinforcing ply 18, the reduced height edges 28 abut each other with the overlying recesses defining an approximately rectangular groove. The recesses 22, and groove formed thereby, are coextensive with the seam defined between the adjacent edge portions of the ply 18.

The seam construction is completed by a continuous reinforcing and sealing strip 30. The strip 30 is of a substantially rectangular configuration and corresponding to the size and configuration of the generally rectangular groove for intimate bonded engagement therein. The bonding of the strip 30 within the recess will be effected through an appropriate adhesive provided between the full areas of surface engagement of the strip 30 with the recess walls 24 and 26.

Construction of the seam joinder in this manner substantially increases the structural stability thereof. As will be appreciated, in addition to the bonding of the edge portions 20 directly to the subjacent ply, and the bonding of the abutted edges 28 to each other, the reinforcing and sealing strip, throughout the full area of surface contact, bonds directly to the horizontal walls 24 of the two recesses 22. Similarly, the opposed longitudinal side edges of the strip 30 bond to the vertical walls 26 of the recesses. Thus, there is a substantial increase in the effective area of surface bonding at the seam which provides enhanced resistance to forces tending to outwardly open the seam. It will be appreciated that the actual height of the reinforcing strip 30 will preferably be equal to or slightly less than the depth of the channel whereby the outer surface of the tube is smooth or provided with a slight depression along the length of the seam. The tube is completed by a pair of overwrapped plies, a first or inner ply of kraft paper and an outer or surface ply of parchment. In each case, these plies are intimately adhesively bonded to the adjacent ply or plies.

The tube of the present invention can be constructed using conventional spiral winding apparatus, along with appropriate means to skive or compress the edge recesses 22. The tube, as with conventional spiral tubes, will be made in a continuous length and subsequently cut to size.

As an example of the proportional size relationship, the reinforcing ply 18 can be $5\frac{1}{4}$ inches in width and have a thickness of 0.015 inches. Each edge recess will have a depth of approximately 0.0035 to 0.004 inches, and a width of $\frac{5}{8}$ inches, thus giving a combined channel width of $1\frac{1}{4}$ inches. The reinforcing strip 30 will be dimensioned to conform to the formed channel. The overlying machine glazed kraft will have a thickness of approximately 0.0025 inches and a width of $5\frac{1}{4}$ inches. The outer or surface parchment will have a thickness of approximately 0.002 inches and a width of $5\frac{5}{8}$ inches.

The strip 30 itself can be a paper or paperboard product. Alternatively, enhanced strength can be obtained by providing strips of an appropriate synthetic resinous material. Such material may include Mylar, a film of polyethylene terephthalate resin, or Tyvek, normally provided as a nonwoven web of fused polypropylene fibers. Both of these materials are products of E.I. Dupont. The use of such synthetic resinous materials becomes particularly significant as the operating speeds, to which the tubes are to be subjected, increase.

Figure 6:
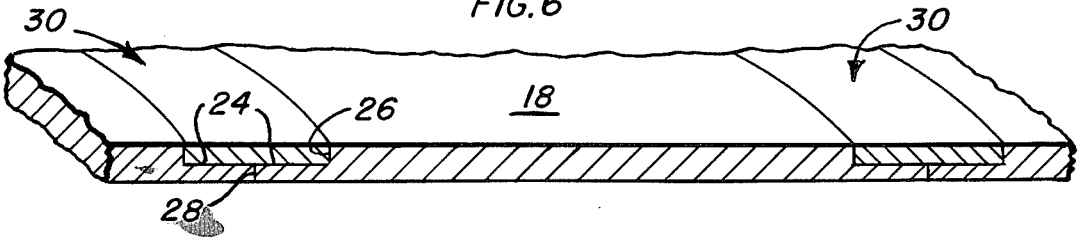
FIG. 6 is a perspective detail of a completed seam.

Noting the cross-sectional detail of FIG. 6, it will be appreciated that even were a line of weakness to develop at the butted and adhesively bonded edges 28, normally the weakest area in a tube of spiral construction, the overlying strip 30, bonded to both the horizontal recess walls 24 and vertical recess walls 26, will provide a positive barrier against any tendency for weakness in the bonded edges 28 to travel throughout the full height of the seam construction, either through the unitarily constructed strip directly overlying the butted edges 28 or along the substantial and angular bonded areas overlying and extending to each side of the butted edges 28. From the foregoing, it is to be appreciated that a unique structurally stable seam has been defined. It is considered significant that the method of constructing tubes in accordance with the invention is such as to enable use of conventional spiral tube winding apparatus.

The foregoing is considered illustrative of the principles of the invention. It is to be appreciated that, within the principles of the invention as defined herein, other embodiments and/or modifications may be recognized and considered to fall within the scope of the invention as hereinafter claimed.

I claim:

1. A carrier tube for textile yarn or the like comprising a multiple ply construction including a base defined by at least one base ply, a tube reinforcing ply surrounding said base and being adhesively bonded thereto, said reinforcing ply being wound about said base and having opposed edges meeting in mutual substantial abutment with each other, an edge portion adjacent and along the length of each edge, a recess in and along each edge portion, the recesses in the edge portions combining to define an elongated channel, said channel being outwardly directed relative to the base of the tube, a reinforcing strip extending along and within said channel, said strip being received in each of said opposed recesses and being bonded therein to the corresponding edge portions, and at least one surface-defining ply wound in surrounding relation to said reinforcing ply and said reinforcing strip.

2. The carrier tube of claim 1 wherein each of said recesses is defined by a pair of generally right angularly related walls, said channel having a generally rectangular cross-section, said strip having a generally rectangular cross-section complimenting that of the channel for engagement of the strip with each of the recess walls.

3. The carrier tube of claim 2 wherein said strip is of a height no greater than the depth of said channel.

4. The carrier tube of claim 3 wherein said strip is made of a synthetic resinous material.

5. The carrier tube of claim 3 wherein said reinforcing ply is spirally wound about said base.

6. The carrier tube of claim 2 wherein said reinforcing ply is spirally wound about said base.

7. The carrier tube of claim 6 wherein said tube is of composite construction including a base of multiple plies of paperboard material.

8. The carrier tube of claim 1 wherein the strip is of a height no greater than the depth of said channel.

9. A method of strengthening a composite tube having a base comprising at least one wound base ply, said method comprising winding reinforcing ply having opposed recessed edge portions about the base, positioning the recessed edge portions immediate adjacent each other, as the reinforcing ply is wound, to define a channel, winding and adhesively securing a reinforcing strip about said reinforcing ply and within the channel, and winding a surface-defining ply about said reinforcing ply and said reinforcing strip.

* * * * *